US005300121A

United States Patent [19]

Gordon et al.

[11] Patent Number: 5,300,121

[45] Date of Patent: Apr. 5, 1994

[54] PROCESS FOR THE TREATMENT OF WOOL SKINS

[75] Inventors: Peter G. Gordon; Udo Adminis, both of Melbourne, Australia

[73] Assignee: Commonwealth Scientific and Industrial Research Organisation, Campbell, Australia

[21] Appl. No.: 823,064

[22] Filed: Jan. 14, 1992

Related U.S. Application Data

[63] Continuation of Ser. No. 423,493, Oct. 12, 1989, abandoned, which is a continuation of Ser. No. 165,271, Feb. 1, 1988, abandoned.

[30] Foreign Application Priority Data

Apr. 28, 1987 [AU] Australia ..... PH5631

[51] Int. Cl.[5] ..... C14C 1/00

[52] U.S. Cl. ..... 8/94.14; 8/94.18; 8/94.19 R; 8/94.21; 8/94.22; 8/128.1

[58] Field of Search ..... 8/94.14, 94.18, 94.19 R, 8/94.22, 128.1

[56] References Cited

U.S. PATENT DOCUMENTS 4,217,104 8/1980 Graf ..... 8/94.14

FOREIGN PATENT DOCUMENTS 129145 12/1945 Australia .
256188 3/1961 Australia .
1601476 7/1976 Australia .
0016014 10/1979 Australia .
6362380 10/1980 Australia .

OTHER PUBLICATIONS

Derwant Abstract Accession No. 85-315318-50 May 1985.

Derwant Abstract Accession No. 30263 D-17 (Aug. 1980).

Derwant Abstract Accession No. 70859C-40 (Feb. 1980).

Encyclopedia of Chemical Technology, 3rd Edition, vol. 14, p. 220, lines 12-13, Kirk-Othmer (1981).

Derwant Abstract No. 92243B-51 (Mar. 1979).

Derwant Abstract Accession No. 86001Y-48 (Apr. 1977).

Derwant Abstract Accession No. 84193960-31 (Nov. 1983).

Derwant Soviet Inventions Illustrated, Apr. 1972 (SUA312872).

Derwant Soviet Inventions Illustrated, Sep. 1966 (SUA208175).

C. Bird, in *The Theory and Practice of Wool Dyeing*, Society of Dyers and Colorists, Chapter 3 at p. 46 (1972).

J. Ward, *Tannage of Medical Sheepskins*, LIRI Research Bulletin No. 718, at p. 1 (1976).

P. Briggs, *Gloving, Clothing and Special Leathers*, Tropical Products Institute, Chapter 5, at p. 67 (1981).

C. Cole, *Proceedings of a Seminar: Leather Technology*, Federated Tanners Association of Australia, Sydney, at p. 1 (1983).

C. M. White and C. C. Wilcock, *Dyeing with Coal-Tar Dyestuffs*; Bailliere, Tindall and Cox; 1952; p. 139.

H. Kaplan, *Furskin Processing*, Permagon Press, p. 213 (1971).

P. S. Briggs, *Wool Sheepskins*, Tropical Products Institute, Chapter 5, pp. 68-69 (1981).

*Primary Examiner*—Ellen M. McAvoy

*Attorney, Agent, or Firm*—Merchant, Gould, Smith, Edell, Welter & Schmidt

[57] ABSTRACT

A method of tanning an animal skin with wool or hair attached thereto wherein the animal skin is pickled in an acidic solution and thereafter tanned in a solution containing at least one tanning agent characterised in that the animal skin is pickled and tanned while a holding agent is present on the wool or hairs and is thereafter scoured so to remove the holding agent.

27 Claims, No Drawings

PROCESS FOR THE TREATMENT OF WOOL SKINS

This is a continuation of application Ser. No. 07/423,493, field on Oct. 12, 1989, now abandoned which is a continuation of prior application Ser. No. 07/165,271, filed on Feb. 1, 1988 now abandoned.

This invention relates to an improved process for the treatment of skins with attached wool or hair.

Whilst the present invention is useful generally in any treatment of skins with wool or hair attached it is described hereafter specifically in relation to the tanning or dyeing of such skins.

Previously known methods utilized for tanning skins with attached wool or hair have included the use of cumbersome apparatus and procedures (some of which are hereafter described) to reduce felting of the wool or hair. (Throughout this specification the term "felting" will be used to cover all types of disarrangement of wool or hair fibres such that fibres are no longer discrete entities which can move independently of other fibres. The term covers all types of entanglement, matting, knotting, twisting, curling, balling and any other arrangements of fibres which prevent the independent movement of a fibre at any place between its root and tip).

Skins used for tanning or dyeing or other such treatment with wool or hair attached (hereinafter referred to as "skins") vary widely in size and quality. The type, colour, and quality of the wool or hair is also highly variable. The wool or hair can be anywhere up to 15cm in length with 2-5 cms being the most commonly encountered. The diameter of the fibre also varies considerably but is generally greater than 25 microns. Smaller diameter wools and hairs have a great tendency to felt.

The conventional procedure presently used for the production of tanned skins with wool or hair attached requires prolonged exposure of the skin to aqueous solutions with mild agitation. The float ratio (being the ratio of the weight of the solution in kg or, approximately, the volume of the solution in litres, to the dry weight of the skin in kg) is normally maintained at a high level (8:1-14:1) in conventional processes to reduce the propensity of the wool or hair to felt. The method and type of agitation depends on the equipment used but those familiar with the art will be aware that agitation is kept to a minimum to avoid or decrease felting.

In previously known and practiced tanning procedures it has been considered essential that the skins be thoroughly cleansed prior to tannage. This pretanning cleansing step is well documented and is discussed and described in "Gloving, Clothing and Special Leathers'-'—Tropical Products Institute, 1981 Chapter 5; "Wool Sheepskins"—P. S. Briggs; "Furskin Processing"—H. Kaplan Pergamon Press 1971 Chapter 8; "Tannage of medical Sheepskins"—G. J. Ward LIRI Research Bulletin No. 718, 1976.

It has also previously been considered necessary to scour and cleanse the wool or hair prior to any dyeing. This is well known and for example, is also documented in "The Theory and Practice of Wool Dyeing" C. L. Bird, Society of Dyers and Colourists 1972, Chapter 3; "Dyeing of Woolly Sheepskins", C. J. Cole, Proceedings of Seminar, "Leather Technology '83", Federated Tanners Association of Australia? Sydney, 1983.

Those familiar with tanning will recognize that the previously known practice for the production of tanned skins with wool or hair attached is subject to wide variation in both chemical reagent usage and procedure depending on the required properties of the final product. Prior to the application of tanning chemicals or dyes it is practice to rid the hair or wool of natural oils, grease and waxes. This has resulted in the need for preliminary cleansing or scouring for periods up to 60 minutes, rinsing of skins and in some cases re-cleansing following the fleshing of the skins. Fleshing removes the attached flesh and fat from the skins. The total cleansing time is frequently in excess of 180 minutes.

In order to reduce the extent to which the hair or wool felts previous processes have required large floats during the tanning step (i.e. the volume of tanning solution per skin is high) and minimal agitation. The floats used in previous processes have been known to range from 20-60 litres/skin and because of the need for minimal agitation it his been necessary to conduct the tanning step for prolonged periods. These periods have most commonly ranged from 16 to 24 hours although they are known to extend to 48 hours.

It is an object of the present invention to provide a process for the treatment of skins with wool or hair attached whereby the disadvantages of previously known procedures are ameliorated without the risk of substantial felting of the wool or hair.

It has been discovered by the inventors that the degree of felting of the wool or hair on skins being tanned, dyed or otherwise treated can be reduced by ensuring that there is a holding agent present on the hairs or wool during the treatment of the skins whether this be the tanning, dyeing or other such treatment. This holding agent may be applied to the wool or hair prior to the treatment steps. The holding agent may be any compound or material which assists in holding the hairs or wool together during the tanning; dyeing or other treatment step. The holding agent can be an industrial oil, wax or other such compound. However, preferably the holding agent is present as the natural oils, waxes and greases which are already present on the hair or wool prior to the normal cleansing and scouring step and there is therefore normally in the case of uncleaned skins no need to specifically add a holding agent.

According to the present invention there is provided a method of tanning an animal skin with wool or hair attached thereto wherein the animal skin is pickled in an acidic solution and thereafter tanned in a solution containing at least one tanning agent characterised in that the animal skin is pickled and tanned whilst a holding agent is present on the wool or hairs and is thereafter scoured so to remove the holding agent.

For the tanning or dyeing of skins with hair or wool attached the following procedure is adopted. Preferably, the skins are fleshed in accordance with known procedures. If found necessary the fresh (green) or preserved (salted, dried or short term preserved by any method) skins are prior to the fleshing step subjected to a soaking process preferably in the absence of surface active agents to remove loosely attached dirt, dung and blood and to re-hydrate preserved skins. Soaking times depend on the nature of the skin but preferably range from 1 to 40 hours with or without the presence of preservatives and with or without agitation.

After the skins have been fleshed they are not further cleansed but are immediately subjected to a pickle treatment. The skins are treated with an acid solution preferably containing an electrolyte. A suitable electrolyte is sodium chloride. Conveniently, the pickling treatment is conducted in a paddle or drum or hide processor although any suitable container may be utilized. Many vessel types are known in the art and any such equipment can be used for the process of the present invention.

The acid used may be organic or inorganic or a combination of organic and inorganic acids. Other chemicals as are known in the art, can be added to the solution to impart special properties to the finished skin. These chemicals can be organic molecules or inorganic molecules which have a tanning action on the skin. The pickling treatment is preferably conducted with either continuous or intermittent agitation for periods up to 16 hours. The volume of the float may vary between 5 to 60 litres per skin and is most preferably in the range between 20 to 30 litres per skin.

Following acid treatment, the pickled stock is then subjected to a tanning procedure preferably using a reduced float which may be for example 5 to 25 litres per skin. Most preferably the float is 12–15 litres per skin thus allowing a corresponding increase in the concentration of tanning agents and auxilliaries. The tanning procedure varies widely in its execution and the materials employed. Known tanning agents and auxilliaries may be used in the tanning step of the present invention utilizing chemicals known in the art to provide both thermal and biological stability to the skins and to bestow on the subsequent leather the desired properties. Again the equipment utilized in the tanning step can be any equipment known in the art including paddles or drums or hide processors so designed to give adequate agitation of the skins. Tanning can be undertaken on equipment that provides vigorous agitation of the skins. Vigorous agitation is preferably performed for any period up to 12 hours and most preferably for 6 hours.

It will be appreciated that this period is substantially less than the period of treatment required in previous tanning steps.

After the skins have been tanned they are then scoured. The skins can be scoured by dry-cleaning methods using, for instance, hydrocarbon solvents or chlorocarbon solvents. Alternatively the skins can be scoured in water. In this step, the residual greases and waxes are easily and rapidly removed to produce clean, tanned (and if desired) dyed skins. When scoured in water, this step is preferably performed in a paddle, drum or hide processor.

A float of 10 to 60 litres per, skin is preferably used and most preferably ranges between 25 and 30 litres per skin. A surface active agent can be added to the water and if so added is preferably added in the range of 1 to 12 grams/litre. Most preferably the surface active agent is added in the range of 3 to 4 grams/litre. A hydrocarbon solvent may be added to the surface active agent. When used the hydrocarbon solvent is added preferably in amounts up to 20 ml per litre with 5–10 ml per litre being most preferred.

The surface active agent may consist of an alkyl phenol derivative of an ethylene oxide condensate with 4–16 carbon atoms in the alkyl radical and 2 to 15 ethylene oxide units in the ethylene oxide moiety with 9 carbon atoms being the most preferred number of carbon atoms in the alkyl radical and 9 ethylene oxide units being the most preferred number of such units in the ethylene oxide moiety. Alternatively a polyalkylene oxide condensate derivative of a fatty alcohol can be used with the alcohol chain containing 4 to 16 carbon atoms and the alkylene oxide chain containing 5 to 15 alkylene oxide units. Mixtures of different surface active agents of the above types may be used. The temperature of the solution is preferably any temperature up to 70° C. and is most preferably in the range of 58° C.–60° C.

As a further preferred surface active agent an amine ethoxylate detergent may be used. Use of this agent has the additional advantage of allowing the scouring or cleansing step to be conducted at lower temperatures. Preferably the temperature of the scouring solution can be as low as 40° C. Most preferably it is 50° C.

Preferably the scouring process is conducted for up to 30 minutes and is preferably in the range 10 to 20 minutes.

The skins are then drained and rinsed with one or two changes of water. Each rinse is preferably equivalent to 10–25 litres of water per skin.

If it is desired to dye the skins this may be done prior to the scouring step. Normal dyeing techniques are utilized except that the "kill" and "prescour" steps (which procedures are well known in the art) are preferably excluded. It has been found that the residual grease and wax so modified following the tanning process promote an even and level dyeing of the wool or hair. Following exhaustion of the dyes the skins are treated in accordance with the scouring process described above. The scouring process can be effected by adding the scouring agents directly to the spent dye solution. In such instance the stock is then drained and if required can be subjected to a further similar cleansing process.

In addition if it is preferred to subject the dyed skins to a re-tanning procedure this may also be done prior to the scouring step. The re-tannage may be performed by the use of appropriate mineral or organic tanning agents (syntans) such as are well known to those practiced in the art. Following the completion of the tannage the skins are treated in accordance with the scouring process already described.

The following examples serve to further illustrate the presently preferred methods of practising the invention.

EXAMPLE 1

140 salted sheep skins of 35mm to 55mm wool length and 17.8 microns–31.7 microns fibre diameter were allowed to soak for I hour in 4000 litres of cold water. Following normal fleshing the stock was divided randomly into two packs of 70 skins which were marked for identification.

One pack was scoured by the normal industrial methods whilst the other pack was allowed to remain in the greasy state.

Both packs were combined and subjected to a normal industrial pickle procedure in a hide processor using acetic acid, sodium chloride and aluminium sulphate as components of the pickle. The float was 14 litres per skin. The hide processor was rotated at 9 rpm for 2 minutes every 30 minutes for 16 hours.

Following pickle 21g/litre of 33⅓% basic chromium sulphate was added to the float and the hide processor was rotated at 4 rpm for 5.25 hours. The skins were then allowed to stand in the tanning solution without agitation for a further 2 hours. Following rinsing and drainage as practiced in a normal industrial procedure the skins were removed. The pack of unscoured skins were then scoured according to the procedures of the present invention. To the 70 skins in the hide processor was added 1600 litres of water at 60° C. and 2 g/litre of a nonyl phenol ethoxylate was added. The hide processor was allowed to rotate for 12 minutes at 3.5 rpm. The skins were drained and rinsed twice with water at 58° C. and once with cold water using normal industrial practice.

A comparison of the two packs revealed that no appreciable felting had occured to the skins scoured after tannage whilst with the pack processed in the conventional manner 28 skins had little or no felting, 20 showed extreme felting and the remainder of the skins exhibited various degrees of felting from slight to severe.

EXAMPLE 2

60 salted woolly sheepskins with fibre lengths of 40–50 mm and of fibre diameter 18–20 microns were soaked in 3,500 litres of cold water for 30 minutes. Following normal fleshing the stock was divided randomly into two packs of 30 skins each and marked for identification. One pack was scoured and rinsed by normal industrial procedure using 70 litres/skin.

Both packs were combined for the pickling step which was conducted as for a normal industrial process in a hide processor. The components of the pickle solution were sodium chloride, aluminium sulphate and formic acid. The float was 14 litres per skin. The hide processor was rotated continuously at 2.5 rpm for 25 minutes and then for 2 minutes every 30 minutes for 17 hours.

To the pickle solution was added 33⅓% basic chromium sulphate at a concentration of 31 g/litre. The hide processor was rotated at 8 rpm for 5 minutes every 30 minutes for 25 hours.

The skins were drained and rinsed following normal practice.

To the 30 unscoured skins in the hide processor was added 25 litres per skin of water at 60° C. together with 4 g/litre of a nonyl phenol ethoxylate. The hide processor was rotated at 5 rpm for 13 minutes. The skins were then drained and rinsed as in normal practice.

An examination of the two packs of skins revealed that no felting had occurred with those skins scoured after tannage whilst for the pack processed by the conventional procedure over 10% had undergone substantial felting whilst another 10% showed varying degrees of felting of a more minor nature.

EXAMPLE 3

6 salted skins of wool length 40–50 mm and fibre diameter of 21–23 microns were soaked in water for 2 hours and fleshed. After pickling in a normal manner using a float of 20 litres per skin, 40 g/litre of sodium chloride and 3 g/litre sulphuric acid the skins were subjected to the following procedure. The skins were placed into a tanning solution consisting of 60 litres of water, 2,400 grams of sodium chloride and 1,200 g of Neosyn RW. Drumming was carried out for 1.5 hours at 11 rpm in an enclosed vessel of approximately 180 litres capacity. 1,200 g of 33⅓% basic chromium sulphate was added and drumming continued for a further 4.5 hours. 20 g of sodium hydrogen carbonate as a 10% solution was added slowly and drumming continued for a further 3 hours. The skins were removed and rinsed with three changes of water. Scouring was conducted by drumming in a float of 30 litres per skin using 2 g/litre of a nonyl phenol ethoxylate at 58°–60° C. for 15 minutes. After rinsing twice with cold water using a total of approximately 30 litres per skin the skins were again scoured in an identical manner to that described.

EXAMPLE 4

82 woolly sheepskins of 25–33 mm length and fibre diameter of 27–30 microns which had been pickled and chrome tanned in a paddle by conventional methods without prior scouring were refloated in a 1200 litre paddle at 60° C. and the pH raised to 6.2 using sodium carbonate. The required mixture of acid dyes was premixed in water with a levelling agent (500 g) (Abegal A-Ciba Geigy). After 50 minutes, 500 ml of 85% formic acid diluted in water was added during 30 minutes.

Neosyn RW (6 kg) (Hodgson Tanning Products) was premixed in water and added to the float in two aliquots during 25 minutes. After 55 minutes, the woolskins were scoured for 20 minutes in the same float using an alkyl phenol ethoxylate mixture (4 g/litre). After draining the skins were refloated and rescoured for 18 minutes using the same detergent composition. The skins, after rinsing and draining were thoroughly clean and exhibited level dyeing.

EXAMPLE 5

60 woolly sheepskins of wool length 35–50 mm and fibre diameter of 27–30 microns which had been pickled and tanned in an unscoured state by conventional methods were refloated in a 1200 litre paddle. 6.4 kg of chromium sulphate powder (26% $Cr_2O_3$; 33⅓% basic; $SO_2$ reduced) was predissolved and added to the paddle and the temperature increased to 40° C. After 35 minutes sodium carbonate was added to slowly raise the pH to 3.7 during 1¼ hours; during the same time the temperature was raised to 50° C. The pH was maintained at this level for 45 minutes whilst the temperature was raised to 58° C. The woolskins were dyed in the same float using an acid dye (100 g) and a levelling agent (500ml) (Airedale Leveller NTD-A; Yorkshire Chemicals) during 80 minutes.

5 kg of a surfactant mixture was added and scouring completed in 15 minutes. The paddle was dropped, the skins refloated and rescoured during 20 minutes using the same surfactant combination. The skins were then drained and rinsed ready for further finishing. Examination revealed that dyeing was level and the wool clean.

EXAMPLE 6

140 salted woolly sheepskins of 38 mm wool length and of fibre diameter 25–30 microns were soaked overnight in cold water prior to fleshing. After fleshing the skins were added to a pickle solution made up as follows: To 4,500 litres of water in a paddle was added sodium chloride to 6 Be (approximately 60 g/litre), 1 k,g of ethylene diaminetetraacetic acid, 3.6 litre of sulphuric acid and 18 litres of 85% formic acid. The skins were paddled for 30 minutes and then agitated intermittently for 90 minutes at 3 minutes every 30 minutes.

56 litres of Paralene AMA (Yorkshire Chemicals) was added and the skins paddled continuously for 30 minutes and then intermittently for 15 hours at 3 minutes per hour.

The pickle was dropped and the skins tanned in the following solution: 4,500 litres of water containing sodium chloride to 4 Bé (approximately 40 g/litre), 1 kg of ethylene diamine tetra-acetic acid, 40 kg of aluminium sulphate? 25 kg of Neosyn HL (Hodgson Tanning Products) and 60 kg of chromium sulphate (26% $Cr_2O_3$;

33⅓% basic; $SO_2$ reduced). The skins were paddled for 30 minutes, then at 3 minutes per hour for 16 hours. The temperature was increased to 35° C. and the pH raised to 3.8 using sodium bicarbonate. The skins were drained and refloated in 4,500 litres of water at 60° C. 18 litres of a surfactant mixture was added and the skins were paddled for 15 minutes. The skins were drained and refloated in water at 60° C. and rinsed for 15 minutes. The skins were again drained and finished out by conventional methods.

EXAMPLE 7

50 skins of fibre diameter of 18–22 microns which had been tanned by the procedure given in Example 6 but not scoured were floated in a paddle containing 1000 litres of water at 60° C. and the pH raised to 6 with sodium carbonate (3 g/litre). 3 kg of Invasol SF (3 g/litre) (Ciba-Geigy) and 3 kg of Sulphirol WS (3 g/litre) (BASF) were added and the skins paddled for 30 minutes. 26 g of an acid dye mixture mixed with a dye levelling agent—Invaderm A (25 g) (Ciba Geigy). The skins were paddled for 30 minutes and then 250 ml of 85% formic acid diluted with water was added slowly to the float and paddling continued for a further 30 minutes. 4 litres of sufactant mixture was added to the float and the skins scoured during 15 minutes. The skins were drained and refloated at 60° C. and scoured again in an identical manner. The skins were drained and rinsed for 10 minutes at 50° C. Examination of the skins revealed the wool pile to be clean and evenly dyed.

Thus the present invention discloses a new process for the production of treated skins with attached wool or hair, making it possible to obtain a significant reduction in felting of wool or hair, during tanning, a significant reduction of felting of hair or wool during dyeing, a significant reduction in processing time—especially that pertaining to the tanning of the skin and a significant reduction in the time required to cleanse or scour the skins. In this regard the process provides for a significant reduction in the staining of the wool by chromium salts where these are used in the tanning step.

Clearly the subsequent benefits of the process are manifested at many stages. These include a saving in tanning chemicals because of the more efficient and rapid uptake due to the use of lower floats and increased agitation; there is a reduction in the volume of solution required and hence a reduction in the effluent; there is a significant reduction in the manual handling of the skins and there is the benefit of using machinery which provides more vigorous agitation and therefore decreased processing time as well as more efficient utilization of tannery space. The method of the invention is particularly well-suited to the treatment of animal skins which have small diameter fibres as these are normally subject to greater difficulties with felting.

Those skilled in the art of tanning will appreciate that the invention described herein is susceptible to variations and modifications other than those specifically described. It is to be understood that the invention includes all such variations and modification which fall within its spirit and scope.

The claim referring the invention are as follows:

1. A process for tanning unscoured wool skins with wool fibers attached thereto; said process comprising the steps of:

(a) providing an unscoured wool skin with wool fibers attached thereto, and with a holding agent thereon in sufficient quantity to hold the wool fibers together during said process; said holding agent being selected from the group consisting of: industrial oil; industrial wax, industrial grease; natural oil, natural wax; natural grease, and mixtures thereof;

(b) pickling said unscoured wool skins containing said holding agent in an acid solution;

(c) following said step of pickling, tanning said wool skins by agitating them in a solution containing at least one tanning agent, wherein the float ratio of tanning solution volume to wool skins is no greater than about 25 liters per skin; and (d) following said steps of pickling and tanning, scouring said wool skins to remove said holding agent therefrom.

2. A process as claimed in claim 1 wherein the acid solution for pickling the skin also contains an electrolyte.

3. A process as claimed in claim 2 wherein the electrolyte is sodium chloride.

4. A process as claimed in claim 1 wherein the pickling step is conducted in a paddle, drum or hide processor.

5. A process as claimed in claim 1 wherein the pickling step is conducted with continuous or intermittent agitation for a period up to 16 hours.

6. A process as claimed in any one of the previous claims wherein scouring of the animal skin is conducted by dry cleaning using a hydrocarbon solvent or a chlorocarbon solvent.

7. A process as claimed in claim 1 wherein scouring of the animal skin is conducted in a float of 10 to 60 litres of water per skin.

8. A process as claimed in claim 7 wherein scouring of the animal skin is conducted in a float of 25 to 30 litres of water per skin.

9. A process as claimed in claim 7 wherein a surface active agent is added to the water in the amount of 1 to 12 grams per litre of water.

10. A process as claimed in claim 9 wherein the surface active agent is added in the amount of 3 to 4 grams per litre.

11. A process as claimed in claim 9 wherein a hydrocarbon solvent is added to the surface active agent in an amount up to 20 ml per litre.

12. A process as claimed in claim 9 wherein the surface active agent is an alkyl phenol derivative of an ethylene oxide condensate with 4 to 16 carbon atoms in the alkyl radical and wherein the ethylene oxide moiety comprises 2 to 15 ethylene oxide units.

13. A process as claimed in claim 12 wherein the surface active agent is an alkyl phenol derivative of an ethylene oxide condensate with 9 carbon atoms in the alkyl radical and wherein the ethylene oxide moiety comprises 9 ethylene oxide units.

14. A process as claimed in claim 9 wherein the surface active agent is a polyalkene oxide condensate derivative of a fatty alcohol with the alcohol chain containing 4 to 16 carbon atoms and the alkylene oxide chain containing 5 to 15 alkylene oxide units.

15. A process as claimed in claim 7 wherein the temperature of the scouring solution is up to 70° C.

16. A process as claimed in claim 15 wherein the temperature of the scouring solution is in the range of 50° C. to 60° C.

17. A process as claimed in claim 9 wherein the surface active agent is an amine ethoxylate detergent.

18. A process as claimed in claim 17 wherein the temperature of the scouring solution is between 40° C. and 50° C.

19. A process as claimed in claim 7 wherein the animal skin is dyed after it has been subjected to tanning treatment but prior to the removal of the holding agent.

20. A process as claimed in claim 18 wherein the skin is subjected to further tanning treatment after it has been dyed but prior to the removal of the holding agent.

21. A process as claimed in claim 1 wherein the float ratio of tanning solution volume to wool skins is no greater than about 15 liters per skin.

22. A process as claimed in claim 1 wherein the float ratio of tanning solution volume to wool skins is between about 12 to 15 liters per skin.

23. A process as claimed in claim 1 wherein the wool skins are agitated vigorously for any period up to 12 hours during said tanning step.

24. A process as claimed in claim 23 wherein the wool skins are agitated vigorously for any period up to 6 hours during said tanning step.

25. A process as claimed in claim 1 wherein the pickling step is conducted in an acid solution wherein the wool skins are agitated in the solution and wherein the float ratio of pickling solution volume to wool skins is no greater than 60 liters per skin.

26. A process as claimed in claim 25 wherein the float ratio of pickling solution volume to wool skins is no greater than 30 liters per skin.

27. A process as claimed in claim 26 wherein the float ratio of pickling solution volume to wool skins is between about 20 to 30 liters per skin.

* * * * *